US010214390B2

(12) United States Patent
Doi

(10) Patent No.: US 10,214,390 B2
(45) Date of Patent: Feb. 26, 2019

(54) PASSENGER CONVEYOR

(71) Applicant: MITSUBISHI ELECTRIC CORPORATION, Chiyoda-ku (JP)

(72) Inventor: Shingo Doi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/760,666

(22) PCT Filed: Nov. 17, 2015

(86) PCT No.: PCT/JP2015/082209
§ 371 (c)(1),
(2) Date: Mar. 16, 2018

(87) PCT Pub. No.: WO2017/085779
PCT Pub. Date: May 26, 2017

(65) Prior Publication Data
US 2018/0370771 A1 Dec. 27, 2018

(51) Int. Cl.
*B66B 21/02* (2006.01)
*B66B 21/04* (2006.01)
(Continued)

(52) U.S. Cl.
CPC ..... *B66B 23/12* (2013.01); *B66B 21/025* (2013.01); *B66B 21/04* (2013.01); *B66B 23/024* (2013.01); *B66B 23/026* (2013.01); *B66B 23/14* (2013.01)

(58) Field of Classification Search
CPC ..... B66B 23/14; B66B 23/145; B66B 23/147; B66B 21/02; B66B 21/025; B66B 21/04; B66B 23/02; B66B 23/022; B66B 23/026
See application file for complete search history.

(56) References Cited

U.S. PATENT DOCUMENTS 994,879 A * 6/1911 Seeberger ..... B66B 23/024 198/329
4,130,192 A * 12/1978 Kraft ..... B66B 23/147 198/327
(Continued)

FOREIGN PATENT DOCUMENTS

JP 58-100081 A 6/1983
JP 58-117467 A 7/1983
(Continued)

OTHER PUBLICATIONS

International Search Report dated Feb. 16, 2016 in PCT/JP2015/082209, filed on Nov. 17, 2015.

*Primary Examiner* — Mark A Deuble
(74) *Attorney, Agent, or Firm* — Xsensus LLP

(57) ABSTRACT

A plurality of steps are linked by endless step chains. Each of the steps includes: a step main body; first shafts that are disposed on the step main body; first step rollers that are disposed on the first shafts, and that are guided by the first guide rails; second shafts that are parallel to the first shafts; and second step rollers that are disposed on the second shafts, and that are guided by the second guide rails. The first shafts move along first pathways, and the second shafts move along second pathways. The second pathways are positioned inside the first pathways when viewed parallel to respective shaft axes of the first shafts. The step chains link each of the steps by joining the second shafts of each of the steps, and are disposed within a range of the step main body in an axial direction of the first shafts.

4 Claims, 5 Drawing Sheets

(51) Int. Cl.

| | |
|---|---|
| ***B66B 23/02*** | (2006.01) |
| ***B66B 23/12*** | (2006.01) |
| ***B66B 23/14*** | (2006.01) |

(56) References Cited

U.S. PATENT DOCUMENTS

| | | | | |
|---|---|---|---|---|
| 5,325,955 | A * | 7/1994 | Ahls | B66B 23/02 198/326 |
| 6,016,902 | A * | 1/2000 | Kwon | B66B 23/147 198/332 |
| 2005/0000778 | A1* | 1/2005 | Hauer | B66B 23/14 198/332 |
| 2008/0135376 | A1* | 6/2008 | Hauser | B66B 23/14 198/322 |
| 2010/0326790 | A1* | 12/2010 | Sanchez Pineiro | B66B 21/08 198/324 |
| 2014/0326577 | A1* | 11/2014 | Inoue | B66B 23/14 198/326 |
| 2017/0275139 | A1* | 9/2017 | Turek | B66B 21/02 |

FOREIGN PATENT DOCUMENTS

| | | | |
|---|---|---|---|
| JP | 2004-359367 | A | 12/2004 |
| JP | 2014185012 | A * | 10/2014 |

* cited by examiner

PASSENGER CONVEYOR

TECHNICAL FIELD

The present invention relates to a passenger conveyor in which a plurality of steps are linked by endless step chains.

BACKGROUND ART

Conventionally, escalators are known in which step chains that join a plurality of steps endlessly are wound around respective sprocket wheels that are disposed on both upper portions and lower portions of trusses, and each of the steps moves cyclically by rotating the sprocket wheels. Front wheels and rear wheels that are guided by mutually different guide rails are disposed on each of the steps. The step chains are connected to shafts of the front wheels of each of the steps. The shafts of the front wheels protrude outward in a width direction from the steps. Consequently, the step chains are disposed outside each of the steps in the width direction (see Patent Literature 1).

CITATION LIST

Patent Literature

[Patent Literature 1]
Japanese Patent Laid-Open No. HEI 4-125290 (Gazette)

SUMMARY OF THE INVENTION

Problem to be Solved by the Invention

However, in the conventional escalator that is disclosed in Patent Literature 1, because the step chains are connected to the shafts of the front wheels of each of the steps, a radius of inversion of the steps is increased in step inverting portions in the upper portions and the lower portions of the trusses, increasing the diameter of each of the sprocket wheels. If the diameters of the sprocket wheels are large, then not only does torque that acts on the sprocket wheels increase, but because the outer circumferential dimensions of the sprocket wheels are increased, the lengths of the step chains are also increased.

Furthermore, in conventional escalators, because the step chains are disposed outside each of the steps in the width direction, it is necessary to ensure movement pathways for the step chains outside each of the steps in the width direction, enlarging the overall width of the escalator.

The present invention aims to solve the above problems and an object of the present invention is to provide a passenger conveyor that enables reductions in size and weight of step sprocket wheels, and that also enables reductions in width dimensions of an escalator.

Means for Solving the Problem

A passenger conveyor according to the present invention includes: first and second guide rails; a plurality of steps that are guided by the first and second guide rails while moving; endless step chains that link the plurality of steps; and step sprocket wheels around which the step chains are wound, wherein: each of the steps includes: a step main body; first shafts that are disposed on the step main body; first step rollers that are disposed on the first shafts, and that are guided by the first guide rails; second shafts that are disposed on the step main body, and that are parallel to the first shafts; and second step rollers that are disposed on the second shafts, and that are guided by the second guide rails; the first shafts move along endless first pathways; the second shafts move along endless second pathways; the second pathways are positioned inside the first pathways when viewed parallel to shaft axes of the first and second shafts; and the step chains link each of the steps by joining the second shafts of each of the steps, and are disposed within a range of the step main body in an axial direction of the first shafts.

Effects of the Invention

According to the passenger conveyor according to the present invention, radii of inversion of step chains can be reduced compared to when the step chains are joined to the first shafts. Lengths of each of the chain links of the step chains can also be shortened. Reductions in size and weight of step sprocket wheels around which the step chains are wound can thereby be achieved. It is also no longer necessary to ensure pathways for the step chains outside the step main body in the width direction, enabling reductions in width dimensions of the passenger conveyor to be achieved.

DESCRIPTION OF EMBODIMENTS

Preferred embodiments of the present invention will now be explained with reference to the drawings.

Embodiment 1

Figure 1:
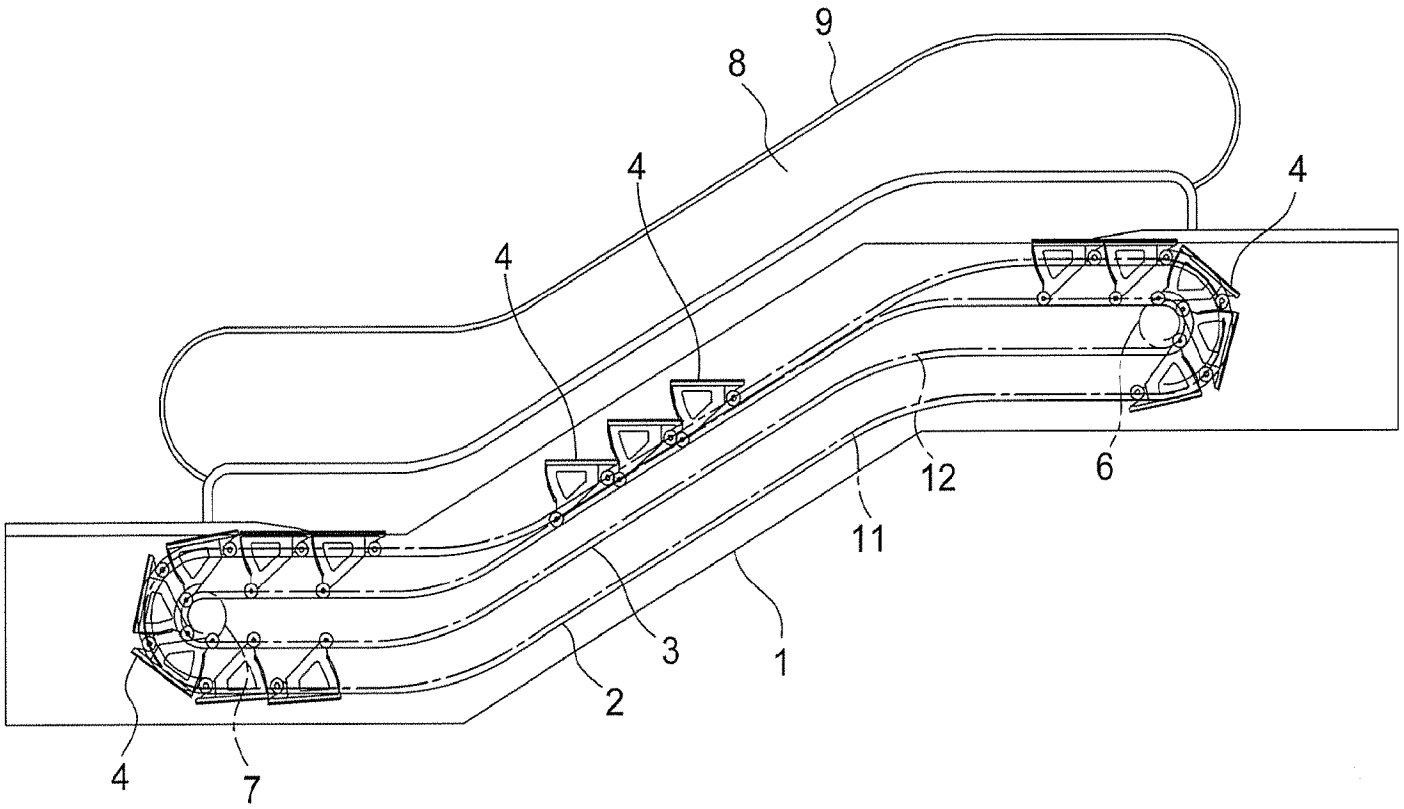
FIG. 1 is a side elevation that shows an escalator that constitutes a passenger conveyor according to Embodiment 1 of the present invention.
Figure 2:
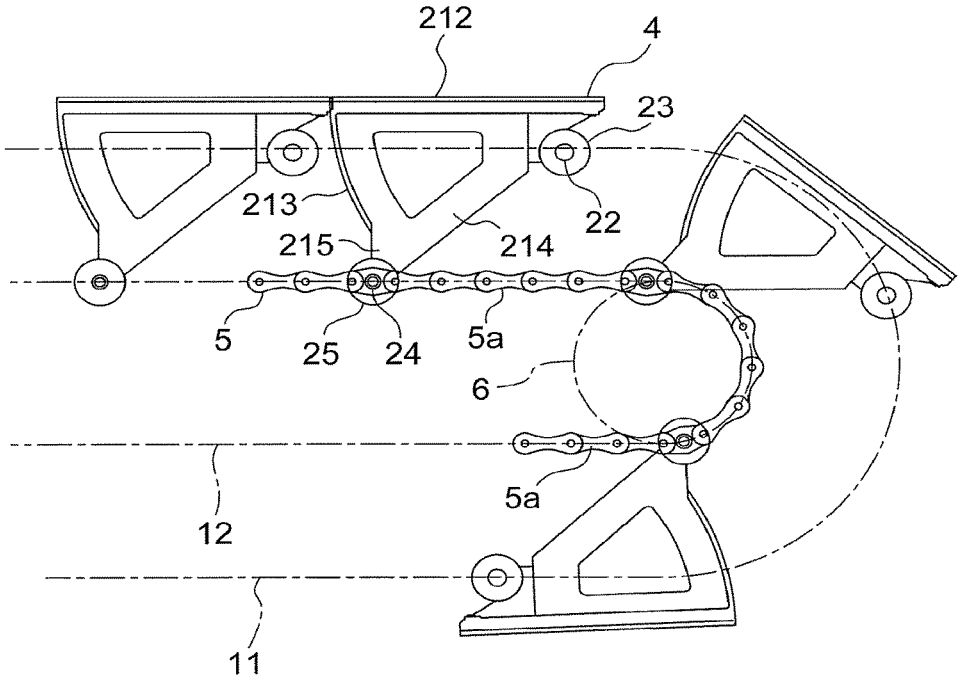
FIG. 2 is a side elevation that shows a first longitudinal end portion of the escalator from FIG. 1.

FIG. 1 is a side elevation that shows an escalator that constitutes a passenger conveyor according to Embodiment 1 of the present invention. FIG. 2 is a side elevation that shows a first longitudinal end portion of the escalator from FIG. 1. In the figures, mounted to trusses 1 are: a pair of first guide rails 2 that are disposed so as to be separated from each other in a width direction of the trusses 1; and a pair of second guide rails 3 that are disposed so as to be separated from each other in the width direction of the trusses 1. A plurality of steps 4 are also supported by the trusses 1. As shown in FIG. 2, the plurality of steps 4 are linked endlessly by a pair of endless step chains 5 that are disposed on two sides in the width direction of the steps 4.

A pair of upper portion step sprockets 6 that are disposed so as to be separated from each other in the width direction of the trusses 1 are disposed at a first longitudinal end portion (in this example, an upper end portion) of the trusses 1. The pair of upper portion step sprockets 6 rotate together around an upper portion sprocket shaft that is parallel to the width direction of the trusses 1. A pair of lower portion step sprockets 7 that are disposed so as to be separated from each other in the width direction of the trusses 1 are disposed at a second longitudinal end portion (in this example, a lower end portion) of the trusses 1. The pair of lower portion step sprockets 7 rotate together around a lower portion sprocket shaft that is parallel to the width direction of the trusses 1. A first of the step chains 5 is wound around a first of the upper portion step sprockets 6 and a first of the lower portion step sprockets 7, and a second of the step chains 5 is wound around a second of the upper portion step sprockets 6 and a second of the lower portion step sprockets 7.

The pair of upper portion step sprockets 6 rotate due to a driving force from a driving machine that is not depicted, which is installed inside the trusses 1. The pair of step chains 5 revolve around the first longitudinal end portions and the second longitudinal end portions of the trusses 1 while rotating the pair of lower portion step sprockets 7 due to the rotation of the pair of upper portion step sprockets 6. Each of the steps 4 moves cyclically while being guided by the pair of first guide rails 2 and the pair of second guide rails 3 due to the revolving motion of the pair of step chains 5.

A pair of railings 8 that face each other in the width direction of the trusses 1 are disposed on the trusses 1. An endless moving handrail 9 is respectively disposed on a circumferential edge portion of each of the railings 8. Each of the moving handrails 9 revolves around each of the railings 8 in synchronization with the steps 4 due to the driving force from the driving machine.

Figure 3:
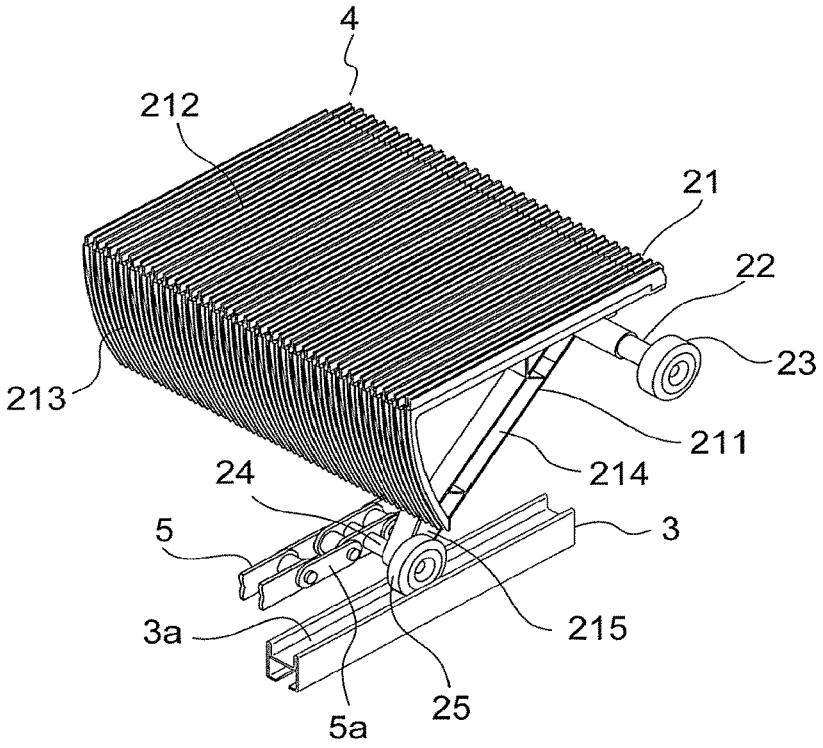
FIG. 3 is an oblique projection that shows part of a step from FIG. 1.

Now, FIG. 3 is an oblique projection that shows part of a step from FIG. 1. Each of the steps 4 has: a step main body 21; first shafts 22 that are disposed on the step main body 21; a pair of first step rollers 23 that are disposed on the first shaft 22; a pair of second shafts 24 that are disposed on the step main body 21, and that are parallel to the first shafts 22; and a pair of second step rollers 25 that are respectively disposed on the second shafts 24. In FIG. 3, of a left side and a right side of the step 4, only the right side is shown, but configuration of the left side of the step 4 is similar or identical to the configuration of the right side of the step 4.

The step main body 21 has: a step frame 211; a footplate 212 that is mounted to the step frame 211, and that carries passengers; and a riser 213 that is mounted to the step frame 211, and that is disposed on a downstairs end portion of the footplate 212. Spaces that are formed between the respective footplates 212 of mutually adjacent steps 4 are closed by the risers 213.

The step frame 211 has: a frame main body 214 that is covered by the footplate 212 and the riser 213; and a pair of protruding portions 215 that each protrude from the frame main body 214 further downstairs than the riser 213. The pair of protruding portions 215 are disposed so as to be separated from each other in the width direction of the steps 4.

The first shafts 22 are disposed on an upstairs end portion of the frame main body 214 so as to be parallel to the width direction of the steps 4. Two end portions of the first shafts 22 protrude from a range of the step main body 21 at two ends in the width direction of the steps 4. The respective first step rollers 23 are mounted to each of the two end portions of the first shafts 22. Consequently, each of the first step rollers 23 is disposed outside the step main body 21 in the width direction.

Each of the second shafts 24 is respectively disposed on the pair of protruding portions 215 of the step frame 211. Each of the second shafts 24 is disposed within a range of the step main body 21 in the width direction of the steps 4. Each of the second step rollers 25 is disposed further outward than each of the protruding portions in the width direction of the steps 4, and is disposed within a range of the step main body 21 in the width direction of the steps 4.

As each of the steps 4 moves, the respective first step rollers 23 are guided separately by the respective first guide rails 2, and the respective second step rollers 25 are guided separately by the respective second guide rails 3. A guiding groove 3*a* that is parallel to a longitudinal axis of the second guide rails 3 is disposed in a first of the second guide rails 3. A first of the second step rollers 25 is inserted into the guiding groove 3*a* of the first of the second guide rails 3. Displacement of each of the steps 4 in the width direction is thereby suppressed when each of the steps 4 moves.

As shown in FIG. 1, as each of the steps 4 moves, the first shafts 22 move along endless first pathways 11 that follow the respective first guide rails 2, and the respective second shafts 24 move along endless second pathways 12 that follow the respective second guide rails 3. When viewed along shaft axes of the first and second shafts 22 and 24 (i.e., when viewed parallel to the width direction of the trusses 1), the second pathways 12 are positioned inside the first pathways 11.

Upper portion inverting portions that are positioned at the first longitudinal end portions of the trusses 1 and lower portion inverting portions that are positioned at the second longitudinal end portions of the trusses 1 exist in each of the first pathways 11 and the second pathways 12. When the first pathways 11 and the second pathways 12 are viewed parallel to the width direction of the trusses 1, respective diameters of the upper portion inverting portions and the lower portion inverting portions of the first pathways 11 are greater than respective diameters of the upper portion inverting portions and the lower portion inverting portions of the second pathways 12. When the second pathways 12 are viewed parallel to the width direction of the trusses 1, the upper portion inverting portions of the second pathways 12 form circular arc shapes that lie along outer circumferential portions of the upper portion step sprockets 6, and the lower portion inverting portions of the second pathways 12 form circular arc shapes that lie along outer circumferential portions of the lower portion step sprockets 7.

As shown in FIGS. 2 and 3, each of the step chains 5 is configured by joining a plurality of chain links 5*a* continuously. Each of the step chains 5 is disposed on the second pathways 12 when viewed parallel to the width direction of the trusses 1. The chain links 5*a* of the step chains 5 intermesh with tooth portions that are disposed on outer circumferential portions of each of the upper portion step sprockets 6 and the lower portion step sprockets 7.

Each of the step chains 5 links each of the steps 4 by joining only the second shafts 24 of each of the steps 4 one by one. In other words, among the pair of step chains 5, a first of the step chains 5 is mounted only to a first of the second shafts 24 of each of the steps 4, and a second of the step chains 5 is mounted only to a second of the second shafts 24 of each of the steps 4. Each of the step chains 5 moves each of the steps 4 while pulling the respective second shaft 24. Consequently, the second step rollers 25 that are disposed on the second shafts 24 that are pulled by the step chains 5 constitute driving rollers, and the first step rollers 23 that are disposed on the first shafts 22 constitute trailing rollers.

Each of the steps 4 is rotatable only around the second shafts 24 relative to the step chains 5. Consequently, even if the steps 4 rotate relative to the step chains 5, the state of the step chains 5 will not change by following the steps 4. Furthermore, as shown in FIG. 3, each of the step chains 5 is disposed within a range of the step main body 21 in the width direction of the steps 4. In this example, each of the step chains 5 is disposed further inward than each of the protruding portions in the width direction of the steps 4.

Next, operation will be explained. When the driving force from the driving machine is transmitted to the upper portion step sprockets 6 such that each of the upper portion step sprockets 6 rotates, then each of the step chains 5 revolves around the first longitudinal end portions and the second longitudinal end portions of the trusses 1. Each of the steps 4 thereby moves cyclically, while the respective first step rollers 23 are guided by the respective first guide rails 2, and the respective second step rollers 25 are guided by the respective second guide rails 3. Each of the moving handrails 9 revolves in synchronization with each of the steps 4. Passengers riding on the footplates 212 of the steps 4 thereby move between the upper portion landing and the lower portion landing.

As each of the steps 4 moves while being guided by the first and second guide rails 2 and 3, the first shafts 22 move along the first pathways 11, and the second shafts 24 move along the second pathways 12. Here, the step chains 5 also move along the second pathways 12 together with the second shafts 24 when the step chains 5 are viewed parallel to the width direction of the trusses 1.

Since the second pathways 12 are positioned inside the first pathways 11, the step chains 5 and the respective second shafts 24 are inverted at the upper inverting portions and the lower inverting portions of the second pathways 12, which have diameters that are smaller than the upper inverting portions and the lower inverting portions of the first pathways 11.

In an escalator of this kind, because the second pathways 12 that constitute movement pathways for the second shafts 24 are positioned inside the first pathways 11 that constitute movement pathways for the first shafts 22 when viewed along shaft axes of the first and second shafts 22 and 24, and the endless step chains 5 link each of the steps 4 by joining the second shafts 24 of each of the steps 4, the radii of inversion of the step chains 5 can be reduced compared to when the step chains 5 are joined to the first shafts 22. Lengths of the respective chain links 5*a* can also be shortened by making the number of chain links 5*a* in the step chains 5 that join mutually adjacent second shafts 24 plural. The respective diameters of the upper portion step sprockets 6 and the lower portion step sprockets 7 around which the step chains 5 are wound can thereby be reduced, enabling cost reductions due to reductions in weight and material reductions in the upper portion step sprockets 6 and the lower portion step sprockets 7 to be achieved. Movement pathway lengths of the step chains 5 can also be shortened due to reductions in size and weight of the upper portion step sprockets 6 and the lower portion step sprockets 7, enabling the lengths of the step chains 5 to be shortened. Escalator costs can thereby be further reduced.

Because the step chains 5 are disposed within a range of the step main bodies 21 in the axial direction of the first shafts 22, it is no longer necessary to ensure space for disposing the step chains 5 outside the step main bodies 21 in the width direction, enabling reductions in width dimensions of the escalator to be achieved while maintaining width dimensions of the step main bodies 21 as before.

Moreover, in the above example, the guiding groove 3*a* is disposed only on the first of the pair of second guide rails 3, but guiding grooves 3*a* may be disposed on both of the pair of second guide rails 3.

Embodiment 2

Figure 4:
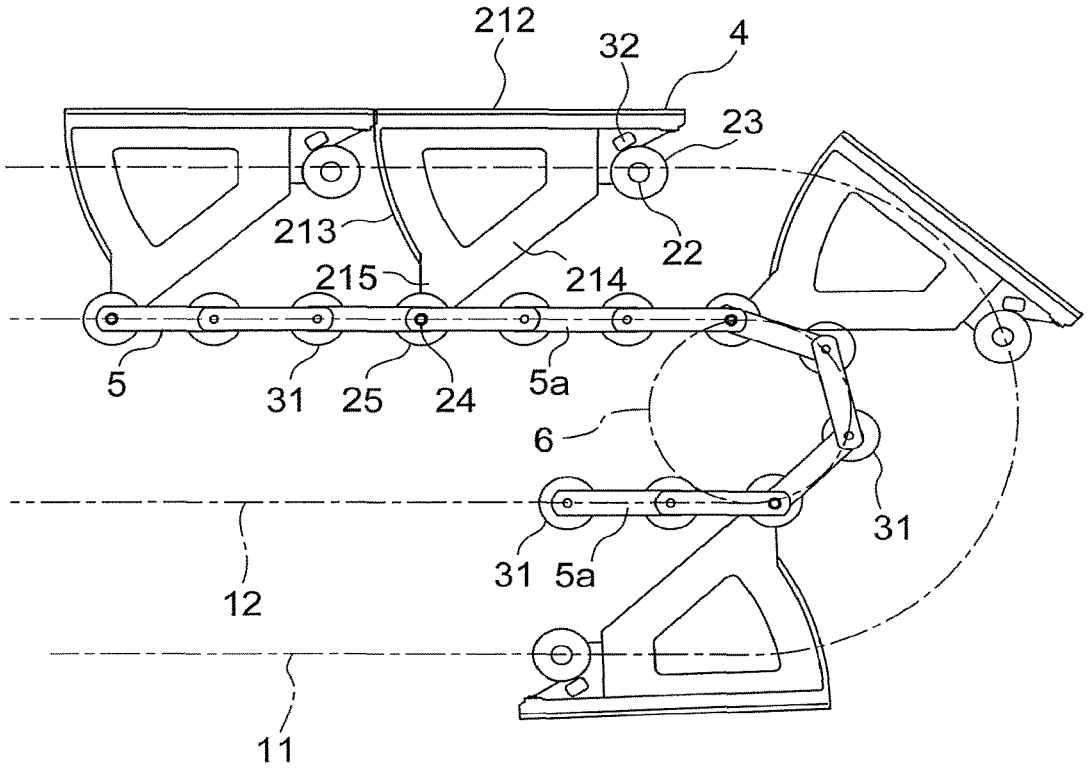
FIG. 4 is a side elevation that shows a first longitudinal end portion of a truss of an escalator according to Embodiment 2 of the present invention.
Figure 5:
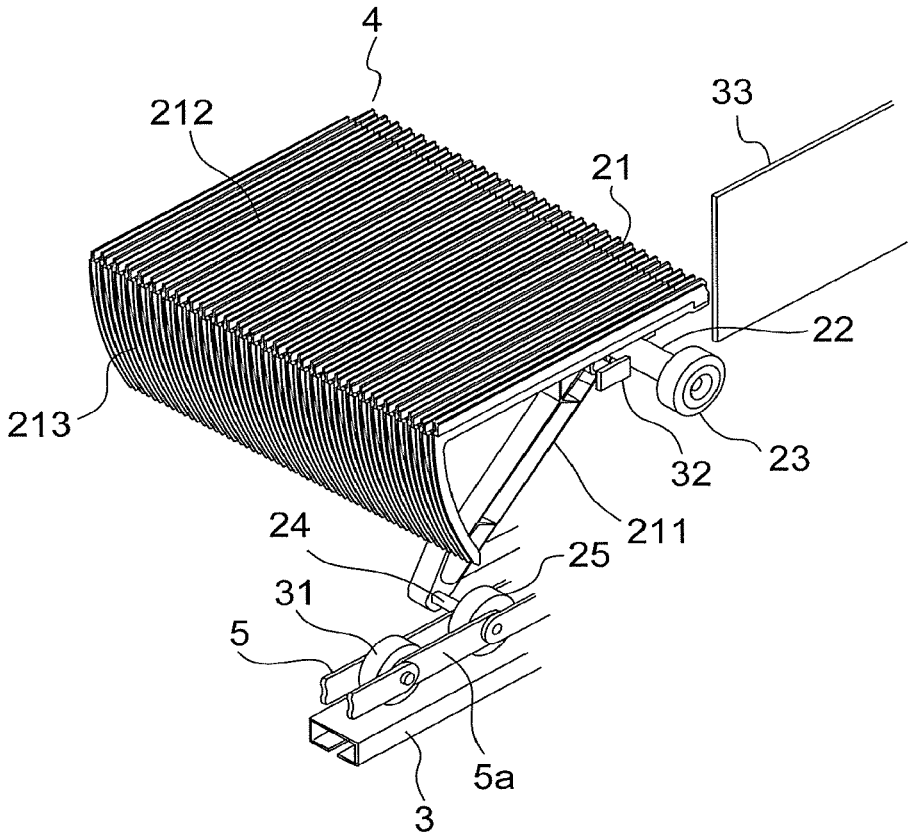
FIG. 5 is an oblique projection that shows part of a step from FIG. 4.

FIG. 4 is a side elevation that shows a first longitudinal end portion of a truss of an escalator according to Embodiment 2 of the present invention. FIG. 5 is an oblique projection that shows part of a step from FIG. 4. Respective step chains 5 link respective steps 4 by joining only second shafts 24 of each of the steps 4 in a similar or identical manner to those of Embodiment 1. Each of the step chains 5 has a plurality of chain links 5*a* that are connected continuously to each other. In each of the step chains 5, mutually adjacent chain links 5*a* are connected together by pins so as to be rotatable. The second shafts 24 of each of the steps 4 also function as pins that rotatably join together mutually adjacent chain links 5*a*.

A plurality of chain rollers 31 that are separately rotatable around the respective pins that join together the chain links 5*a* are mounted to each of the step chains 5. The chain rollers 31 are different rollers than second step rollers 25. The respective chain rollers 31 and the respective second step rollers 25 are disposed in single rows at a uniform spacing in longitudinal directions of the step chains 5. In this example, the outside diameter and the thickness of each of the chain rollers 31 are equal to the outside diameter and the thickness of the second step rollers 25.

The second step rollers 25 are disposed further outward than respective protruding portions of step frames 211 in a width direction of the steps 4. Each of the step chains 5 and each of chain rollers 31 are thereby also disposed further outward than the respective protruding portions of step frames 211 in the width direction of the steps 4. Each of the step chains 5, each of the chain rollers 31, and each of the second step rollers 25 are disposed within a range of a step main body 21 in the width direction of the steps 4.

The respective chain rollers 31 and the respective second step rollers 25 are guided by the second guide rails 3 as each of the steps 4 moves. In this example, a guiding groove 3*a* such as that of Embodiment 1 is not disposed on the second guide rails 3, the respective chain rollers 31 and the respective second step rollers 25 instead rolling on flat surfaces of the second guide rails 3.

A pair of guiding pads 32 that protrude from the step main body 21 on two sides in the width direction are disposed on a frame main body 214 of each of the steps 4. In this example, the guiding pads 32 are disposed at positions on the frame main body 214 between a footplate 212 and first shafts 22.

A pair of tabular restricting members 33 that respectively face the guiding pads 32 on the left and right of each of the steps 4 in the width direction of the steps 4 are fixed to the trusses 1. The pair of restricting members 33 are disposed so as to be parallel to the movement pathways of the guiding pads 32 on two sides in the width direction of each of the steps 4. As each of the steps 4 moves, displacement of each of the steps 4 in the width direction is restricted by the guiding pads 32 contacting at least one of the pair of restricting members 33. Portions of the guiding pads 32 that face the restricting members 33 are constituted by a material that has higher flexibility than the restricting members 33. The positions of the pair of restricting members 33 are further inward in the width direction of the steps 4 than the positions of the respective first step rollers 23. A remainder of the configuration is similar or identical to that of Embodiment 1.

In an escalator of this kind, because a plurality of chain rollers 31 that are guided by the second guide rails 3 are disposed on the step chains 5, not only the second step rollers 25, but also the respective chain rollers 31, can be guided by the second guide rails 3 as each of the steps 4 move. The step chains 5 can thereby be moved stably.

Because guiding pads 32 protrude outward from the step main bodies 21 in the width direction, and restricting members 33 face the guiding pads 32, displacement of the steps 4 in the width direction can be restricted by the guiding pads 32 contacting the restricting members 33. The occurrence of derailment of the first and second step rollers 23 and 25 from the first and second guide rails 2 and 3 can thereby be prevented.

Moreover, in the above example, each of the step chains 5, each of the chain rollers 31, and each of the second step rollers 25 are disposed further outward than each of the protruding portions of the step frame 211 in the width direction of the steps 4, but each of the step chains 5, each of the chain rollers 31, and each of the second step rollers 25 may be disposed further inward than each of the protruding portions of the step frame 211 in the width direction of the steps 4.

In the above example, a guiding groove 3*a* is not disposed on the second guide rails 3, but a guiding groove into which respective second step rollers 25 and respective chain rollers 31 are inserted may be disposed on at least one of the respective second guide rails 3.

In each of the above embodiments, the present invention is used in an escalator that constitutes a passenger conveyor, but the present invention may be applied to a moving walkway that constitutes a passenger conveyor.

The invention claimed is:

1. A passenger conveyor comprising:

first and second guide rails;

a plurality of steps that are guided by the first and second guide rails while moving;

endless step chains that link the plurality of steps; and step sprocket wheels around which the step chains are wound, wherein:

each of the steps comprises:

a step main body;

first shafts that are disposed on the step main body;

first step rollers that are disposed on the first shafts, and that are guided by the first guide rails;

second shafts that are disposed on the step main body, and that are parallel to the first shafts; and second step rollers that are disposed on the second shafts, and that are guided by the second guide rails;

the first shafts move along endless first pathways;

the second shafts move along endless second pathways;

the second pathways are positioned inside the first pathways when viewed parallel to shaft axes of the first and second shafts; and the step chains link each of the steps by joining the second shafts of each of the steps, and are disposed within a range of the step main body in an axial direction of the first shafts.

2. The passenger conveyor according to claim 1, wherein chain rollers that are guided by the second guide rails are disposed on the step chains, and the chain rollers are different than the second step rollers.

3. The passenger conveyor according to claim 1, wherein:

a guiding pad protrudes outward from the step main body in a width direction; and a restricting member that faces the guiding pad is fixed to a truss to which the first and second guide rails are mounted.

4. The passenger conveyor according to claim 2, wherein:

a guiding pad protrudes outward from the step main body in a width direction; and a restricting member that faces the guiding pad is fixed to a truss to which the first and second guide rails are mounted.

* * * * *